US006929049B2

(12) United States Patent
Nicolosi

(10) Patent No.: US 6,929,049 B2
(45) Date of Patent: Aug. 16, 2005

(54) STRUCTURE FOR DOUBLE GLAZING HAVING A GLASS-ENCLOSED CHAMBER WITH VENETIAN BLIND, ELECTRICALLY CONNECTED TO AN OPERATING DEVICE AFTER INSTALLATION

(75) Inventor: Giovanni Nicolosi, Dresano (IT)

(73) Assignee: Pellini SRL, Codogno (IT)

( * ) Notice: Subject to any disclaimer, the term of this patent is extended or adjusted under 35 U.S.C. 154(b) by 0 days.

(21) Appl. No.: 10/416,783

(22) PCT Filed: Jan. 19, 2001

(86) PCT No.: PCT/IT01/00028

§ 371 (c)(1),
(2), (4) Date: May 15, 2003

(87) PCT Pub. No.: WO02/053865

PCT Pub. Date: Jul. 11, 2002

(65) Prior Publication Data

US 2004/0020606 A1 Feb. 5, 2004

(30) Foreign Application Priority Data

Dec. 29, 2000 (IT) ..... MI2000A2869

(51) Int. Cl.[7] ..... E06B 3/323
(52) U.S. Cl. ..... 160/107
(58) Field of Search ..... 160/107, 98, 168.1 P, 160/176.1 P, 188, 310

(56) References Cited

U.S. PATENT DOCUMENTS 4,979,552 A * 12/1990 van der Zanden ..... 160/107
6,095,223 A * 8/2000 Rossini et al. ..... 160/107

FOREIGN PATENT DOCUMENTS

WO 98 10164 A 3/1998

* cited by examiner

*Primary Examiner*—Blair M. Johnson
(74) *Attorney, Agent, or Firm*—Michael J. Striker

(57) ABSTRACT

Structure (10) for a glass-enclosed chamber (9) formed of a frame (11) consisting of four channel-shaped pieces (15, 16, 17, 18), angular joins (20) and an angular connection (30) and comprising a blind (80) carried by a box (50) inside the glass-enclosed chamber (9) worked by a device with an electric motor, inside said box (50) and electrically connected to an electric socket (60) situated at one end of said box (50), said socket (60) being shaped so as to permit conjunction, due to matching of the top of the box (50) with the upper channel (18) of the frame (11), to an electric plug (38) with pins-terminals (40–42) for connection by electric wiring to a device for electric feed and control outside the glass-enclosed chamber (9), said plug (38) being placed in the angular connection (30) of the frame (15–18), situated at said end of the box (50).

4 Claims, 5 Drawing Sheets

FIG.2
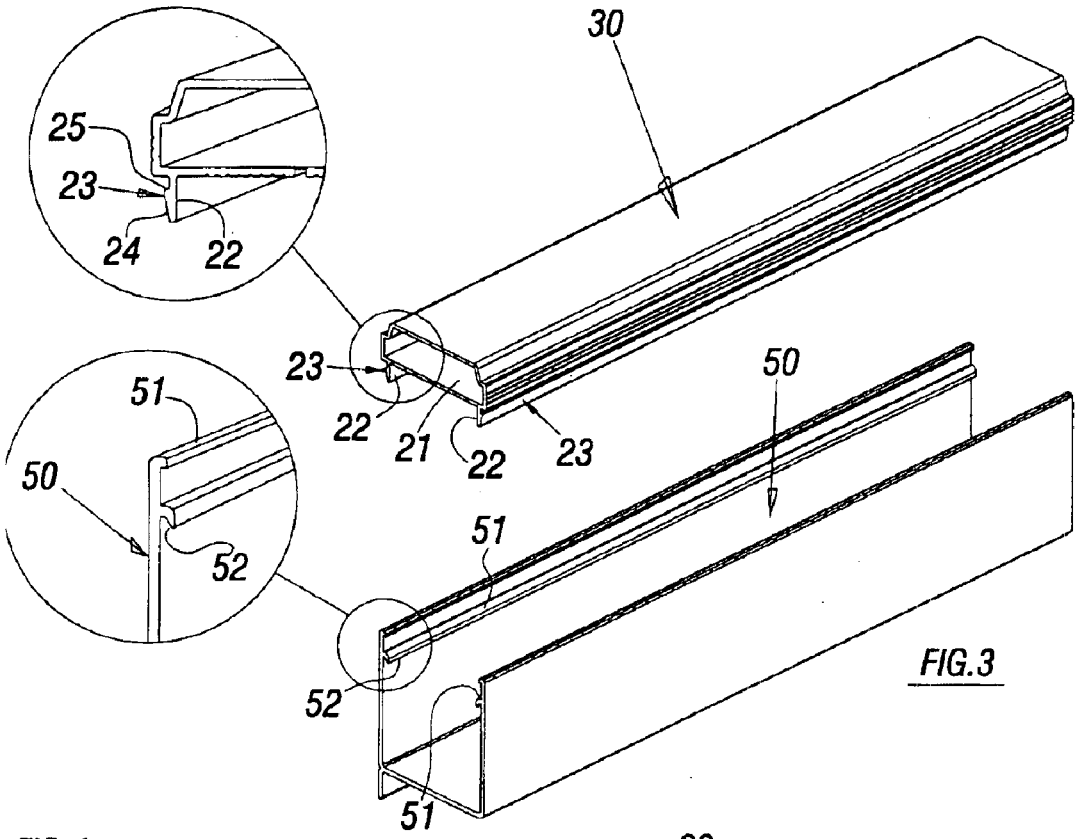
FIG.3
FIG.4
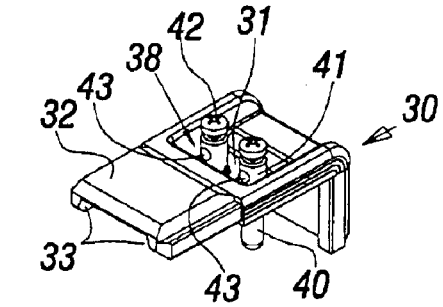
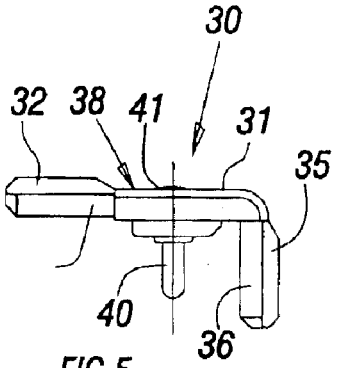
FIG.5
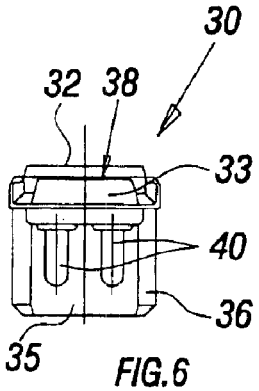
FIG.6
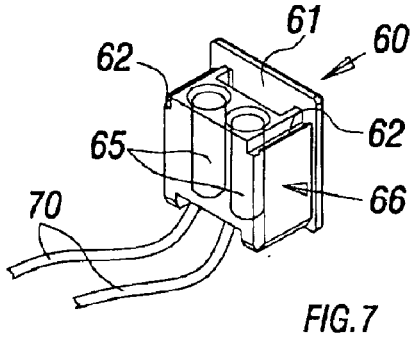
FIG.7
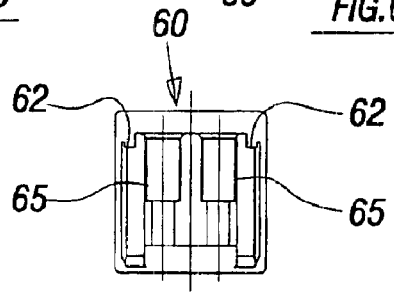
FIG.8

STRUCTURE FOR DOUBLE GLAZING HAVING A GLASS-ENCLOSED CHAMBER WITH VENETIAN BLIND, ELECTRICALLY CONNECTED TO AN OPERATING DEVICE AFTER INSTALLATION

BACKGROUND OF THE INVENTION

The invention concerns structures for a glass-enclosed chamber with a blind.

Well known are the double-glazing structures with a venetian or pleated blind, worked by an internal electric motor operated from outside.

Most of the heat from inside a residential building is lost through the glass panes of windows and french windows.

Much of this loss can be prevented by installation of double-glazing structures, namely two panes of glass, enclosing a hermetically sealed chamber, in place of a single pane.

The presence inside this chamber of a venetian or of a pleated blind leads to considerable complications as the blind has to be lowered and raised by external devices without damaging the hermetic seal.

Various methods of working the blind have been invented and applied using internal mechanisms connected to external ones by magnetic couplings with lines of force acting through the glass.

If blinds are operated by an electric motor inside a box-shaped structure that supports the blind, the fitter installing the double glazing is given four channel-shaped pieces for the top, bottom and sides, four angle joints and a kind of oblong box to support the blind, already screwed onto the upper piece.

The electric wires to feed the motor emerge from a hole in the top of said upper piece.

Having prepared said channel-shaped pieces, inserting hygroscopic salts, the fitter assembles the frame, applies an adhesive to its edges and puts in the two glass panes to enclose the chamber.

This work must be done with great care as much handling is needed and the product could easily be damaged.

The wires that emerge from the top channel-shaped piece tend to hinder assembly and perimetral sealing, partly because they may rub against the glass and break.

All the above makes it difficult to use the automatic equipment available at glassworks so that extra personnel and extra time are required, and problems of quality may be created.

The holes made to screw the upper channel onto the frame that supports the blind and those for passage of wiring for electric feed and external operation, adversely affects the hermetic seal.

Special care is needed in transporting the double-glazing structure to avoid breaking the electric wires that emerge from the top.

The above invention eliminates these difficulties and drawbacks as will now be explained.

SUMMARY OF THE INVENTION

Subject of the invention is a structure for double glazing consisting of a quadrangular frame formed by four channel-shaped pieces for the top, bottom and sides with joints for the corners, and comprising a blind supported by an oblong box inside the double-glazing structure worked by a device with an electric motor inside said box.

Said device is electrically connected to a first means for electrical connection placed at one end of said box and so shaped as to permit its being joined to a second means for electrical connection to a feed and operating device outside the double-glazing structure.

Said second means is situated in the angular connection of the frame at said end of the box.

As the top of the box matches with the upper channel-shaped piece of the frame, the first and second means for electrical connection become joined.

The first means consists of an electric socket with two bushings placed vertically and crosswise to the box with the top substantially flush with its edge, electrically connected to the device with an electric motor inside said box.

The second means consists of an electric plug with vertical pins facing towards the bottom of a base made of insulating material forming part of the angular connection for joining the upper channel-shaped piece to one lateral piece of the frame.

At one end of the base there is a horizontal extension made to fit into the upper channel of the frame and at the other end a vertical extension to fit into the lateral channel.

The socket and plug are so placed that the geometrical axes of the bushings of the socket coincide with those of the pins on the plug.

The pins have an extension above the base said extension forming terminals with a transversal hole and locking screw.

On matching the top of the box with the upper channel-shaped piece of the frame, the pins of the plug therefore fit into the bushings of the socket so that when electric wires are applied to said terminals, electrical connection is established between the device inside the box and the device for electric feed and control outside the chamber formed by the panes of glass.

At the longitudinal ends of the outer wall of the base of the upper channel of the frame, are vertical extensions substantially shaped like a longitudinal elastic tongue having an external back inclined outwards from its end as far as a transversal tooth.

The box part is formed of a substantially square U-shaped piece the edges of whose vertical walls are turned inwards to form longitudinal hooks so that, on pressing the box against the upper channel-shaped part of the frame, the extensions on said upper piece of the frame automatically and securely hook into said edges of the box and simultaneously the pins of the plug fixed to the upper part of the frame fit into the bushings of the socket fixed to the box.

The socket for electric current consists of a small block of insulating material comprising, in a single piece parallel to the bushings, a plate substantially as long and as wide as the external cross section of the U-shaped piece that forms the box carrying the blind.

At the upper ends of said block are two parallel grooves so shaped and so situated that, when said block fits into one end of the box, said grooves match with longitudinal hook-shaped extensions close to their edges, this too helping to hold said block firm.

When the block is fully inserted, the plate substantially closes said end of the box.

Before the sealing material is applied to the entire free peripheral volume, created between the outer surface of the frame and the two panes of glass respectivelly fitted one to one face and the other to the other face of said frame, the base with the two terminals which, when the frame is completely assembled, remains outside the upper channel-shaped piece, is then protected by a plug that substantially seals off the area above the base, therefore sealing off the electrical parts as well.

When the sealing material has dried out, any kind of tool can be used to remove the material that has covered the plug which can then be lifted out to give access to the terminals.

The invention offers evident advantages.

Assembly of the double-glazing structure becomes quick and easy as use can be made of automatic equipment at the glassworks since no electric wiring protrudes outside the frame.

The double-glazing structure is securely sealed as there are no screws in the upper channel-shaped piece nor any wires passing through it.

The snap-in connection between the box that supports and works the blind and the upper piece of the frame, is greatly facilitated and stability for the entire structure is assured.

On receiving the box with the blind and the four pieces for top, bottom and sides, the fitter need only assemble the frame and put in the first pane of glass.

All the other operations, such as mounting the second pane of glass, applying pressure to both panes, peripheral sealing and anything else, are automatic and therefore need no human labour.

Transport requires no special precautions as there is no electrical wiring on the outside.

Once the structure has been installed in the window frame, all that has to be done is connect the external wiring for feed and control to the terminals on the plug.

All this means economy, quick installation, a secure hermetic seal and reliable operation.

Characteristics and purposes of the invention will be made still clearer by the following example of its execution illustrated by diagrammatically drawn figures.

BRIEF DESCRIPTION OF THE DRAWINGS

FIG. 2 Upper channel-shaped piece for the frame, in perspective with enlarged detail of one of the hook-like extensions to the base.

FIG. 3 Shaped piece for forming a box-type structure to carry and operate the venetian blind, in perspective, with enlarged detail of one extension, similar to a hook, on the internal walls.

FIG. 4 Angular part for mechanically joining the shaped pieces of the frame and for electrical connection and control, in perspective.

FIG. 5 As above, side view.

FIG. 6 As above, front view.

FIG. 7 Small block for closing and electrically connecting the box that carries the blind.

FIG. 8 As above, front view.

DESCRIPTION OF THE PREFERRED EMBODIMENT

Figure 1:
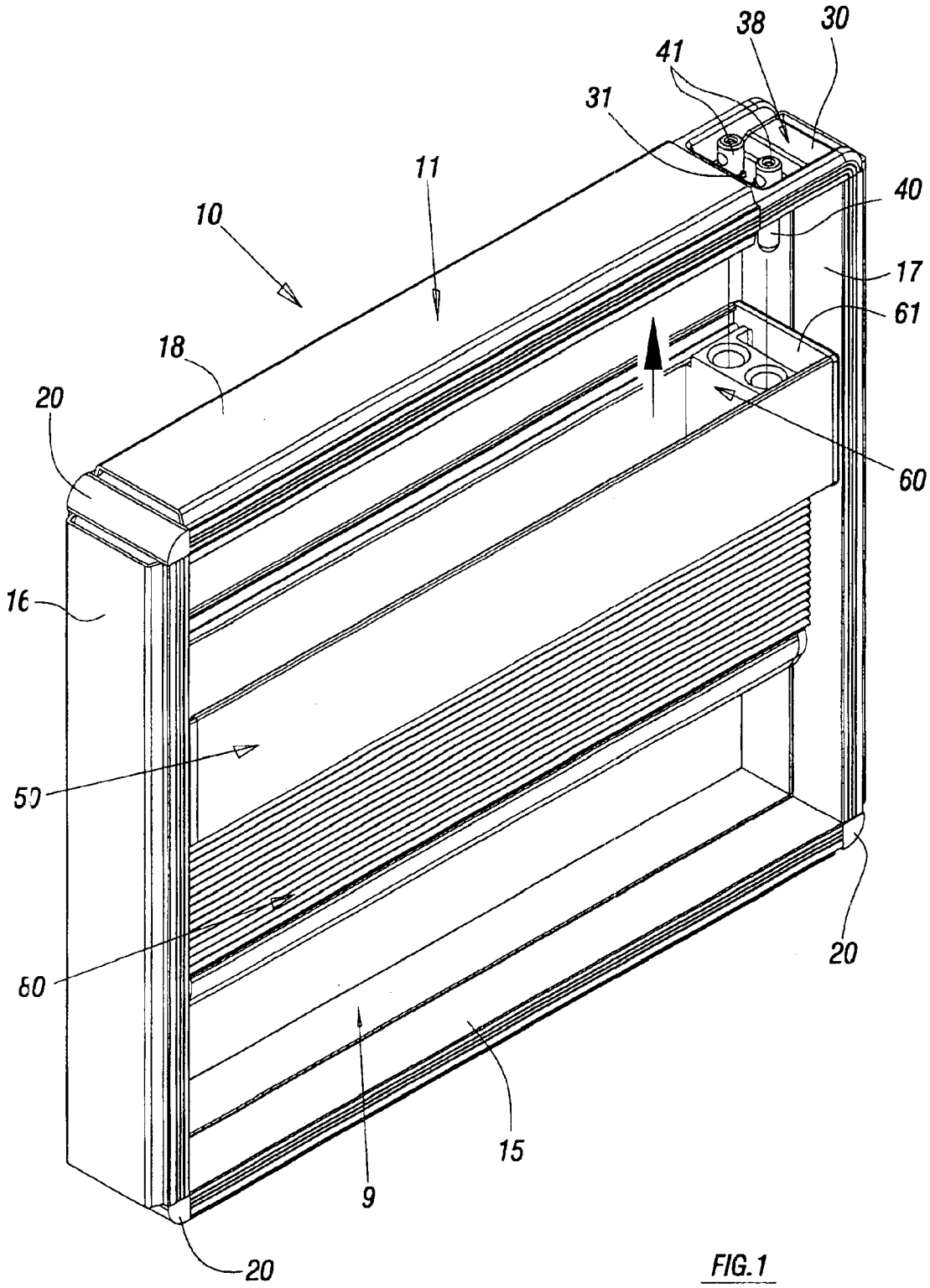
FIG. 1 Structure with frame for a venetian blind in a glass-enclosed chamber, nearly completed, perspective view.

FIG. 1 shows the base structure 10 for the glass-enclosed chamber 9 comprising a frame 11 and means, subject of the invention, to facilitate assembly and electrical connection, ensuring a hermetic seal due to elimination of any fixing screws that protrude outside and any electrical wiring passing through.

As in known models, the lower 15 and lateral 16 and 17 channel-shaped pieces are joined together by angular parts 20.

At one end the upper channel 18 is joined to the lateral channel 16 by an angular part 20 while, at the other end, it is joined to the lateral channel 17 by means of a mechanical-electrical angular join 30 for mechanical as well as electrical connection to the electric motor situated in the box-like structure 50 formed of a shaped piece having a cross section in the form of a square "U" (FIG. 3) that carries the venetian blind 80, for its remote control.

Below its base 21, said upper channel 18 (FIG. 2) presents a pair of lateral elastic vertical extensions 22 each being provided, at the end of the external wall, with a hook 23 the back 24 of which is inclined as far as a tooth 25. The upper edges 51 of the box 50 are bent inwards also forming hooks 51.

The dimensions and positions of the pair of hooks 23 on the upper channel 18 and of the pair of hooks 51 on the box 50 that carries the venetian blind 80, are such that, on pressing said box 50 against the upper channel 18 of the frame 11, said pairs of hooks 23 and 51 snap together so producing an automatic spontaneously irreversable connection between the frame 11 and said box 50.

The above-mentioned angular connection 30, made of plastic insulating material, presents (FIG. 4) a central base 31 having at one side a substantially coplanar extension 32 ribbed underneath 33 and, at the other, a bracket 35 set at 90°, ribbed 36 inside.

The shape and size of said extension 32 and of said bracket 35 are such as to permit said angular connection 30 to be fitted both into the horizontal channel 18 and into the vertical channel 17.

Fixed substantially in the centre of the base 31 is an electric plug 38 having a pair of pins 40 which, on passing through said base, form the pair of terminals 41 fixed with screws 42, for electric wiring that can pass through the crosswise holes 43 in said terminals.

On the internal walls of the box 50, close to its upper edges, are hook-shaped extensions 52 facing towards the bottom of said box.

On the end corresponding to the position of the angular connection 30 on said box 50, these hooks 52 firmly hold in place an electric socket 60 formed of a small block (FIG. 7) of plastic material on which, at the rear end, in a single piece, is a small vertical plate 61 whose external dimensions are substantially the same as those of said end of the shaped piece that forms the box 50.

The width of socket 60 is the same as the internal width of the box 50, there being at the top of said socket a pair of lateral grooves 62 that permit insertion of the socket inside the box 50 by fitting said grooves into said hooks 52 present on its walls.

This insertion having been made, the plate 61 substantially closes one free end of the box 50.

Said socket 60 presents two bushings 65 parallel to the plate 61, so placed that, when the socket 60 is fitted into the shaped piece of the box 50, their geometrical axes coincide with the vertical geometrical axes of the pins 40 and, since the top of the box 50 matches with the upper channel 18 of the frame 11, electrical connection is thus made between the bushings 65 on the socket and the pins 40.

Figure 9:
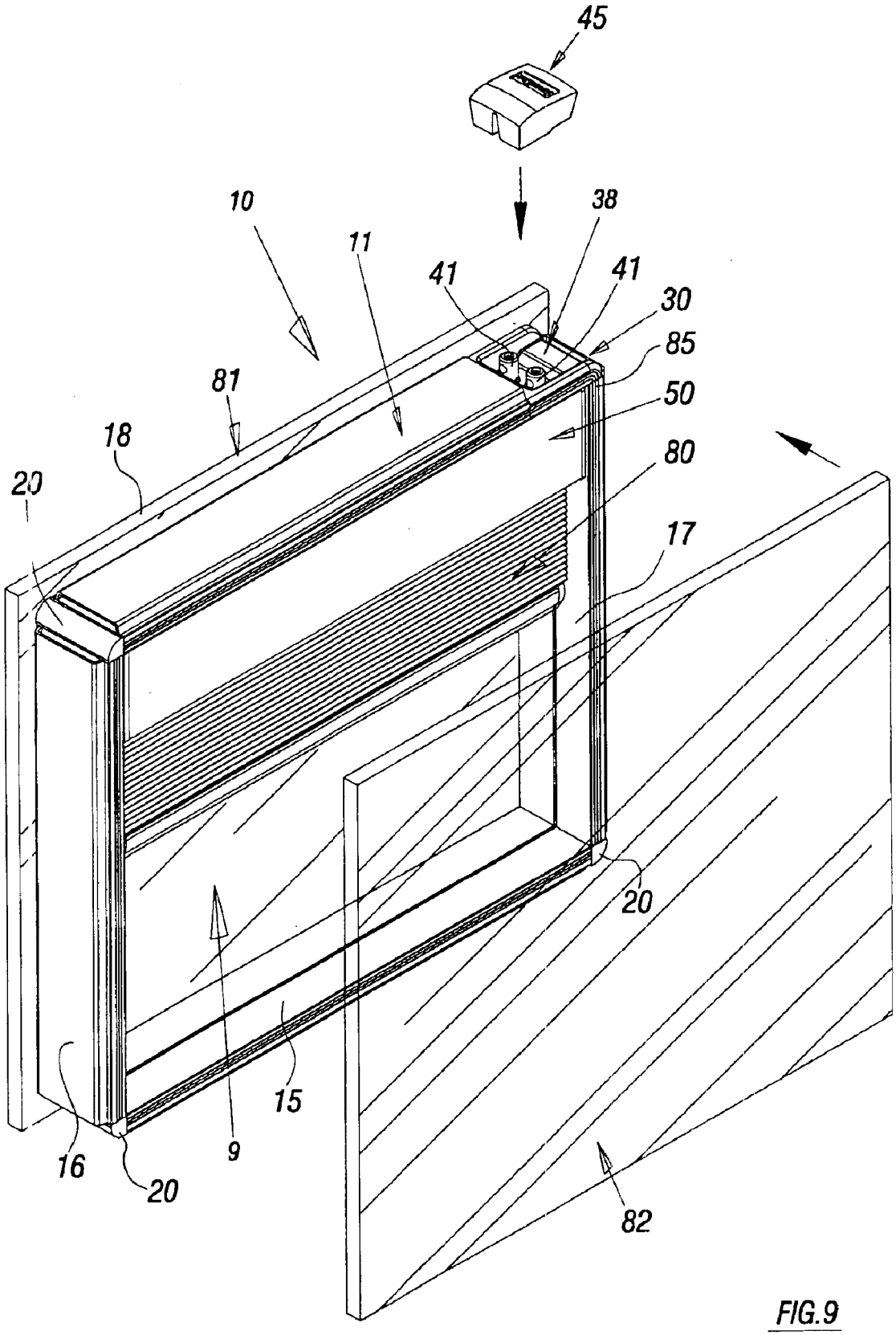
FIG. 9 Perspective of the glass-enclosed chamber-nearing completion.
Figure 12:
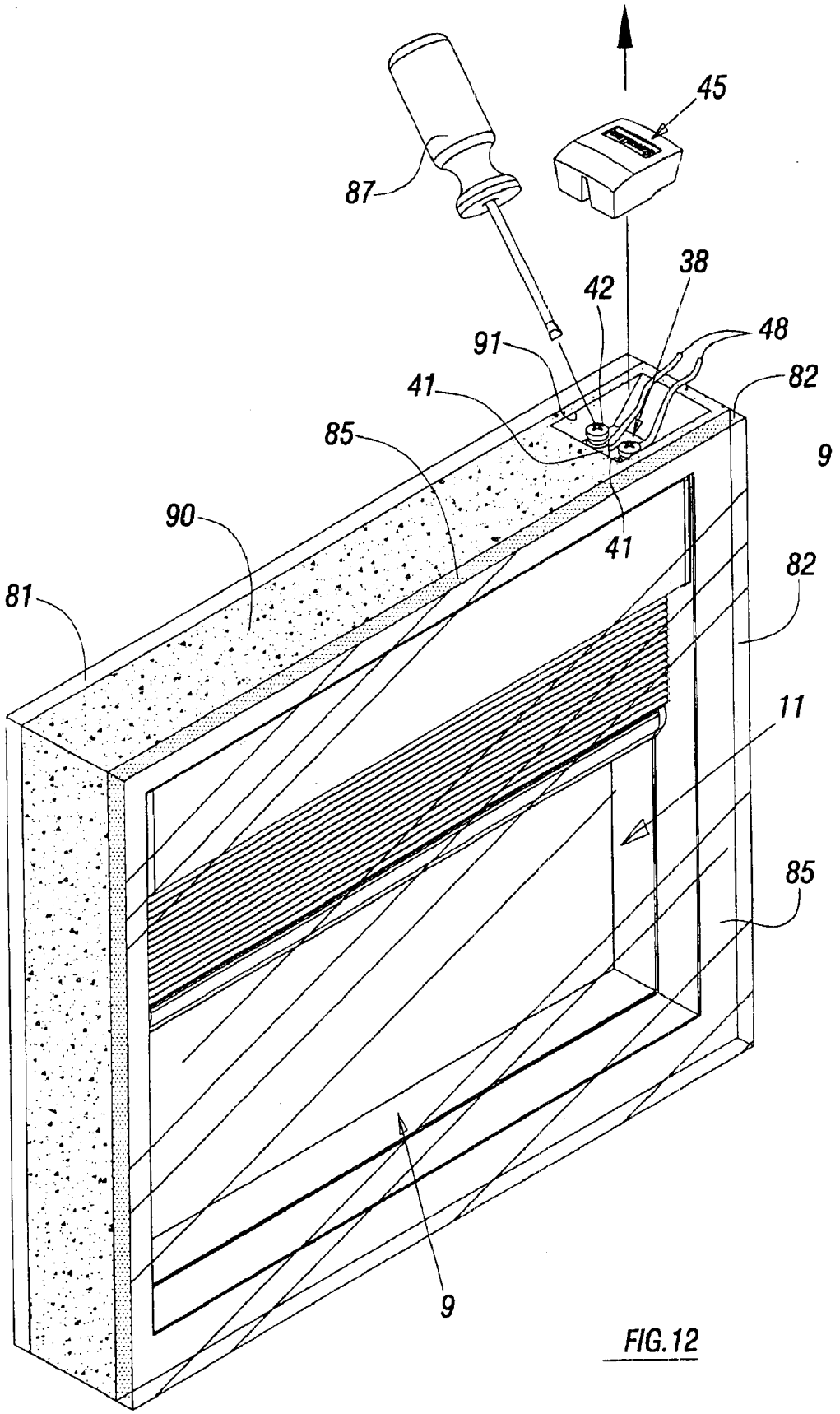
FIG. 12 Perspective of the chamber during installation.

Said bushings 65 are electrically wired 70 to the electric motor that operates the blind 80 so that mechanical assembly of the structure 10 of the glass-enclosed chamber 9 also determines electrical connection between said electric motor and said pins 40, these in turn being connectable to an external electric feed and control device through the terminals 41 and wires 48, as seen in FIG. 12. As may be seen in FIGS. 9 and 12, the described structure 10 permits regular assembly and completion of the glass-enclosed chamber 9.

On receiving components such as the box 50 with blind 80 and the four channel-shaped pieces 15–18, and after putting the usual hygroscopic salts into said channels, the fitter assembles them, using the three angular parts 20 and the angular connection 30 with the electric plug, then by pressing said box 50 into the upper channel-shaped piece 18 spontaneous irreversable snap-in connection is determined between the two and simultaneous insertion of the pins 40 on the plug into the bushings 65 of the socket.

The fitter then mounts the frame 11 and box 50, with its blind 80, onto the first glass pane 81.

All subsequent operations, such as application of the second glass pane 82, pressing in the two panes, filling round the periphery 90 with sealing material, can be done automatically, without human labour.

Figure 10:
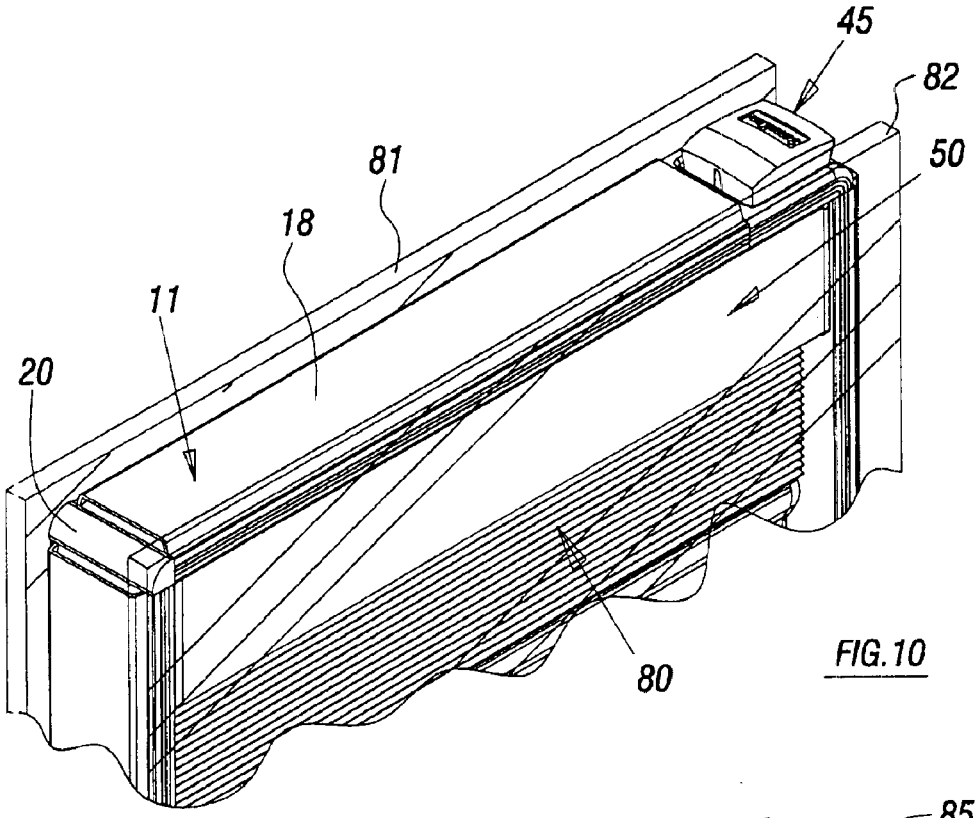
FIG. 10 Perspective of the completed chamber.

Before peripheral sealing 90 is done, the protective plug 45 is fitted onto the angular part 30, said plug consisting of a block so shaped as to fit into the space left free by the channel 18 and match with the electrical parts to ensure that no filling material can get into them, as shown in FIG. 10.

Figure 11:
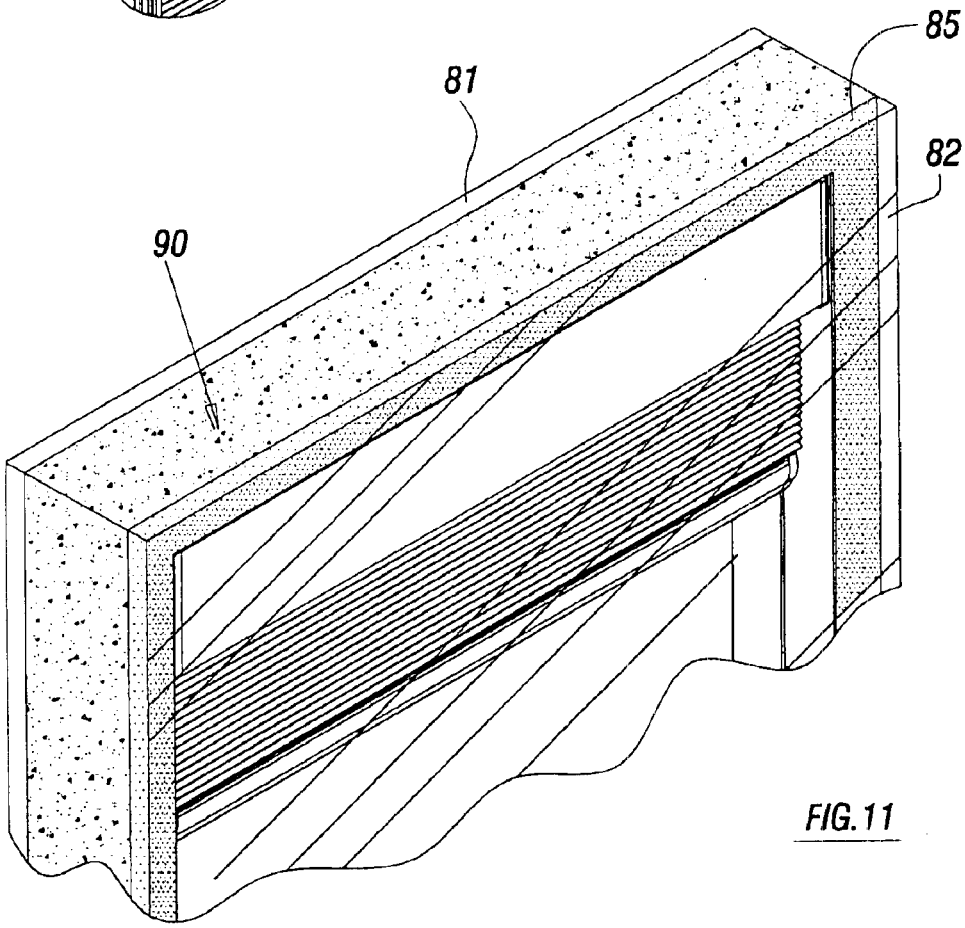
FIG. 11 Perspective of the glass-enclosed chamber with peripheral seal.

FIG. 11 illustrates the possibility of perfect and complete sealing 90 since, as shown in FIG. 12, when drying is complete, even a simple tool 87 can be used to free and extract the protective plug 45, freeing the space 91, the wires 48, for connection to an external device for electric feed and for operating the blind, then having to be connected to the terminals 41.

As the present invention hs been described and explained solely as an example not limited to this, and to show its essential features, it is understood that numerous variations may be made to it in accordance with industrial, commercial and other requirements, and that other systems and means may be included in it without causing a departure from its sphere of use.

It is therefore clear that the application to patent comprises any equivalent use of the concepts and any equivalent product executed and/or in operation according to any one or more of the characteristics set forth in the following claims.

What is claimed is:

1. Structure (10) for a glass-enclosed chamber (9) formed of a quadrangular frame (11) consisting of four channel-shaped pieces (15–18), an upper one (18), a lower one (15) and lateral ones (16, 17) and angular joining parts (20) and comprising a blind (80) supported by an oblong box (50) inside the glass-enclosed chamber and worked by a device with an electric motor inside said box, wherein the device inside the box (50) is electrically connected to a first means (60) for electrical connection placed at one end of said boxy (50) and so shaped as to permit conjunction with a second means (38) for electrical connection to an electrical feed and control device outside the glass-enclosed chamber, said second means (38) being situated in an angular connection (30) of the frame (11) at said end of said box (50), determining conjunction between the first (60) and the second (38) means for electrical connection consequent upon matching the top of the box (50) with the upper channel-shaped piece (18) of the frame (11) wherein the first means (60) is a socket (60) for electrical current with two bushings (65) placed vertically and crosswise to the box (50), the top being substantially flush with its edge, electrically connected to the device with electric motor inside said box (50) while the second means (38) is an electric plug (38) with vertical pins (40) facing downwards on a base (31) of insulating material forming part of the angular connection (30) for joining the upper channel (18) with one lateral channel (17) of the frame (11), said base (31) having at one end a horizontal extension (32) to be fitted inside the upper channel (18) of the frame 11, and at the other end, a vertical extension (36) to be lifted into the lateral channel (17) of said frame (11), the positions of the socket (60) and of the plug (38) being such that the geometrical axes of the bushings (65) on the socket and of the pins (40) on the plug coincide, the pins (40) having an extension above the base (41) that forms terminals (41) with a crosswise hole (43) and locking screw (42), so that by matching the top of the box (50) with the upper channel (18) of the frame (11), the pins (40) of the plug enter the bushings (65) of the socket permitting, by application of electric wires (48) to said terminals (41), electrical connection between the device inside the box (50) and the electrical feed and control device outside the glass-enclosed chamber.

2. Structure (10) for a glass-enclosed chamber (9) formed of a quadrangular frame (11) consisting of four channel-shaped pieces (15–18), an upper one (18), a lower one (15) and lateral ones (16, 17) and angular joining parts (20) and comprising a blind (80) supported by an oblong box (50) inside the glass-enclosed chamber and worked by a device with an electric motor inside said box, wherein the device inside the box (50) is electrically connected to a first means (60) for electrical connection placed at one end of said box (50) and so shaped as to permit conjunction with a second means (38) for electrical connection to an electrical feed and control device outside enclosed chamber, second means (38) being situated in an angular connection (30) of the frame (11) at said end of said box (50), determining conjunction between the first (60) and the second (38) means for electrical connection consequent upon matching the top of the box (50) with the upoer channel-shaped piece (18) of the frame (11), wherein the upper channel-shaped piece (18) of the frame (11) presents, in the longitudinal end of an external wall of its base (21), vertical hooks (22) these substantially being extensions shaped like a longitudinal elastic tongue (23) having an external back (24) inclined outwards from its end as far as a transversal tooth (25), while the box (50) consists of a shaped part substantially in the form of a square "U" the edges of whose vertical walls turn inwards to form longitudinal books (51), so that on pressing said box (50) against the upper channel (18) of the frame (11), automatic and spontaneously irreversable connection is made between the hooks (22) on the upper channel (18) of the frame and said hooks (51) on the box (50) and simultaneously introduction of pins (40) of the plug (38) fixed to the angular connection (30), into bushings (65) of a socket (60) fixed to said box (50).

3. Structure (10) for a glass-enclosed chamber as in claim 1, characterized in that the socket (60) for electric current is formed of a small block (66) of insulating material comprising, in a single piece and parallel to the bushings (65), a small plate (61) whose length and width are substantially the same as those of the cross section of the U-shaped piece that forms the box (50) carrying the blind (80), there being at the upper ends of said block (66) two parallel grooves (62) so shaped and situated that, when said block (66) is inserted at one end of the box (50), said grooves receive hooks (52) formed of longitudinal extensions made inside the longitudinal walls of said box (50) close to its edges (51) contributing to stability of said block (66) while the plate (61) substantially closes said end of the box.

4. Structure (10) for a glass-enclosed chamber (9) as in claim 1, characterized in that the base (31) of the plug (45) with the two terminals (41), remaining, on completion of installation of the frame (11), outside the upper channel (18), is protected, before the seating material (90) is filled in all roudn the free peripheral volume crested between the external surfaces of the frame (11) and the two panes (81, 82) of glass respectively applied to the two faces of said frame (11), bu a plug (45) that provides a substantially hermetic seal to the upper area of the base (31) therefore also protecting said terminals (41), it being possible, when the sealing material (90) has dried, to detatch the dried sealing material covering the plug (45) using any simple tool for the purpose, and then remove said plug to give access to the terminals (41).

* * * * *